United States Patent [19]

Stephenson

[11] 4,323,356

[45] Apr. 6, 1982

[54] MARINE TRANSMISSION CONTROL WITH VIBRATION ISOLATION SYSTEM

[75] Inventor: Donald K. Stephenson, Sussex, Wis.

[73] Assignee: Outboard Marine Corporation, Waukegan, Ill.

[21] Appl. No.: 14,696

[22] Filed: Feb. 23, 1979

[51] Int. Cl.[3] ..... B63H 21/26

[52] U.S. Cl. ..... 440/86; 74/470; 74/473 R

[58] Field of Search ..... 188/266, 280, 312, 313, 188/314; 74/480 B, 470, 490, 503, 473 R; 440/900, 84, 86; 267/8 R, 8 B, 34

[56] References Cited

U.S. PATENT DOCUMENTS

| | | | |
|---|---|---|---|
| 1,273,059 | 7/1918 | Hild | 188/312 |
| 1,689,032 | 10/1928 | Johnson | 115/18 R |
| 2,478,858 | 8/1949 | Buske | 115/18 R |
| 2,772,649 | 12/1956 | Gensheimer et al. | 115/17 X |
| 2,836,986 | 6/1958 | Kretz | 74/470 |
| 3,145,688 | 8/1964 | Kincannon | 115/18 R |
| 3,290,035 | 12/1966 | Enke | 267/8 R |
| 3,317,012 | 5/1967 | Heidner et al. | 115/17 X |
| 3,465,851 | 9/1969 | Callegari et al. | 74/473 R X |
| 3,863,592 | 2/1975 | Borst | 115/17 |
| 3,919,964 | 4/1975 | Hagen | 115/17 X |
| 4,096,820 | 6/1978 | Hall | 115/17 |

FOREIGN PATENT DOCUMENTS

| | | | |
|---|---|---|---|
| 696895 | 10/1964 | Canada | 115/18 R |
| 2658019 | 7/1978 | Fed. Rep. of Germany | 74/473 R |
| 598884 | 10/1959 | Italy | 115/17 |

*Primary Examiner*—Sherman D. Basinger

*Attorney, Agent, or Firm*—Michael, Best & Friedrich

[57] ABSTRACT

A marine propulsion device comprises a marine propulsion unit including an engine and a rotatably mounted propeller, together with a transmission operatively connected with the engine and the propeller for operation between a neutral position and a drive position, and a shift control mechanism which includes a control handle operatively connected with the transmission for transmitting operative forces from the control handle to the transmission to operate the transmission between its neutral position and its drive position. The shift control mechanism further includes an isolation assembly for transmitting the operative forces from the control handle to the transmission while isolating the transmission of vibratory forces from the transmission to the control handle.

7 Claims, 2 Drawing Figures

MARINE TRANSMISSION CONTROL WITH VIBRATION ISOLATION SYSTEM

BACKGROUND OF THE INVENTION

I. Field of the Invention

The invention relates generally to marine propulsion devices, and more particularly, to transmission controls for marine propulsion devices. Still more particularly, the invention relates to vibration isolation systems for transmission controls for outboard motors.

II. Description of the Prior Art

Conventional marine transmission controls are subject to vibration emanating from the transmission. The vibration creates tactile sensations in the palm of the operator's hands and lends a feeling of "roughness" to the operation of the transmission control.

Attention is directed to the energy dissipating or absorbing devices which are disclosed in the following United States Patents:

| | | |
|---|---|---|
| Rison | 637,668 | November 21, 1899 |
| Fowler | 1,304,955 | May 27, 1919 |
| Olson | 1,815,631 | July 21, 1931 |
| Weber | 2,134,770 | November 1, 1938 |
| Hedrick | 2,261,155 | November 4, 1941 |
| Groves | 2,295,731 | September 15, 1942 |
| Johnson | 2,628,044 | February 10, 1953 |

SUMMARY OF THE INVENTION

The invention provides a marine propulsion device comprising a marine propulsion unit including an engine, a rotatably mounted propeller, and transmission means operatively connected with the engine and the propeller for operation between a neutral position in which the engine is operatively disconnected from the propeller and a drive position in which the engine powers the propeller. Control means is provided which includes a control handle which is operatively connected with the transmission means for transmitting operative forces from the control handle to the transmission means to thereby operate the transmission means between the neutral position and the drive position. The control means further includes isolation means for transmitting the operative forces from the control handle to the transmission means and for isolating transmission of vibratory forces from the transmission means to the control handle.

In accordance with one embodiment of the invention, the control means includes means for mounting the control handle for movement relative to the marine propulsion unit and linkage means operatively connected with the movably mounted control handle for transmitting operative forces to the transmission means in response to movement of the control handle. In this embodiment, the isolation means includes damper means operatively connected with the linkage means for resisting the transmission of vibratory forces by the linkage means and spring means operatively connected with the linkage means in series with the damper means for limiting the magnitude of vibratory forces which are transmitted from the transmission means to the damper means.

In accordance with one embodiment, the linkage means includes a shift rod having a longitudinal axis and movable axially along the longitudinal axis in response to operative forces imparted by movement of the control handle and in response to vibratory forces imparted by operation of the transmission means. In this embodiment, the damper means includes a cylinder enclosing a portion of the shift rod, a piston attached to the enclosed portion and movable within the cylinder in common with movement of the shift rod axially along the longitudinal axis, and an incompressible fluid confined in the cylinder to resist the rapid movement of the piston therein. Also in this embodiment, the spring means includes a helical spring operatively connected with the shift rod intermediate the cylinder and the transmission means, which spring is compressed in response to movement of the shift rod axially along the longitudinal axis.

In accordance with one embodiment, the spring means includes a second helical spring in addition to the first mentioned spring, which second spring is operatively connected with the shift rod intermediate the control handle and the cylinder.

In accordance with one embodiment, a steering handle is attached to the marine propulsion unit, and the control handle mounting means includes means for attaching the control handle on the steering handle for rotation relative thereto.

In accordance with the embodiment, a control box is remotely spaced from the marine propulsion unit, and the control handle mounting means includes means for attaching the control handle on the control box for movement relative thereto.

One of the principal features of the invention is the provision of a transmission control mechanism which permits the conduction of operative forces from the control handle to the transmission to operate the transmission while isolating the conduction of the vibratory forces from the transmission to the control handle, thereby permitting the operator to control shifting of the transmission while substantially eliminating the undesirable higher frequency tactile sensations transmitted to the palm of the operator's hand during operation of the transmission.

Other features and advantages of the embodiments of the invention will become apparent upon reviewing the following general description, the drawings, and the appended claims.

Figure 1:
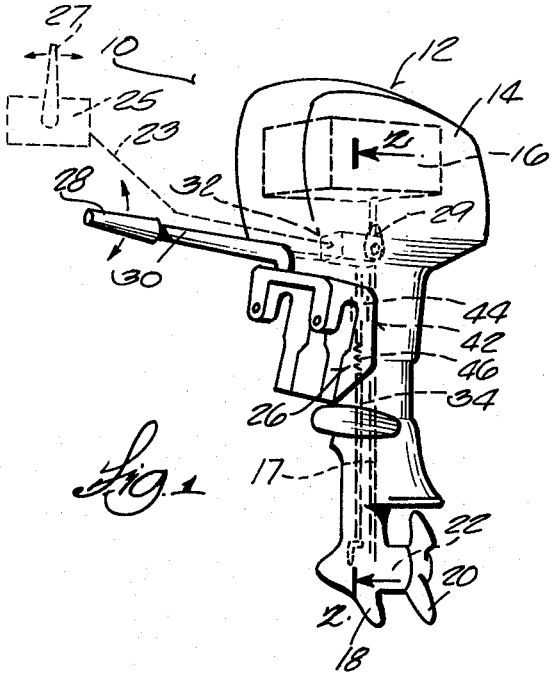
FIG. 1 is a perspective and partially diagrammatic view of a marine propulsion device which embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology used herein for the purpose of description should not be regarded as limiting.

GENERAL DESCRIPTION

Shown in FIG. 1 is a marine propulsion device 10 which embodies various of the features of the invention. In the illustrated embodiment, the propulsion device 10 is in the form of an outboard motor and comprises a propulsion unit 12 having a powerhead section 14 which includes an engine 16 having a drive shaft 17, which engine 16 is typically an internal combustion engine. The device 10 further includes a lower drive section 18 upon which a propeller 20 is rotatably mounted.

Figure 2:
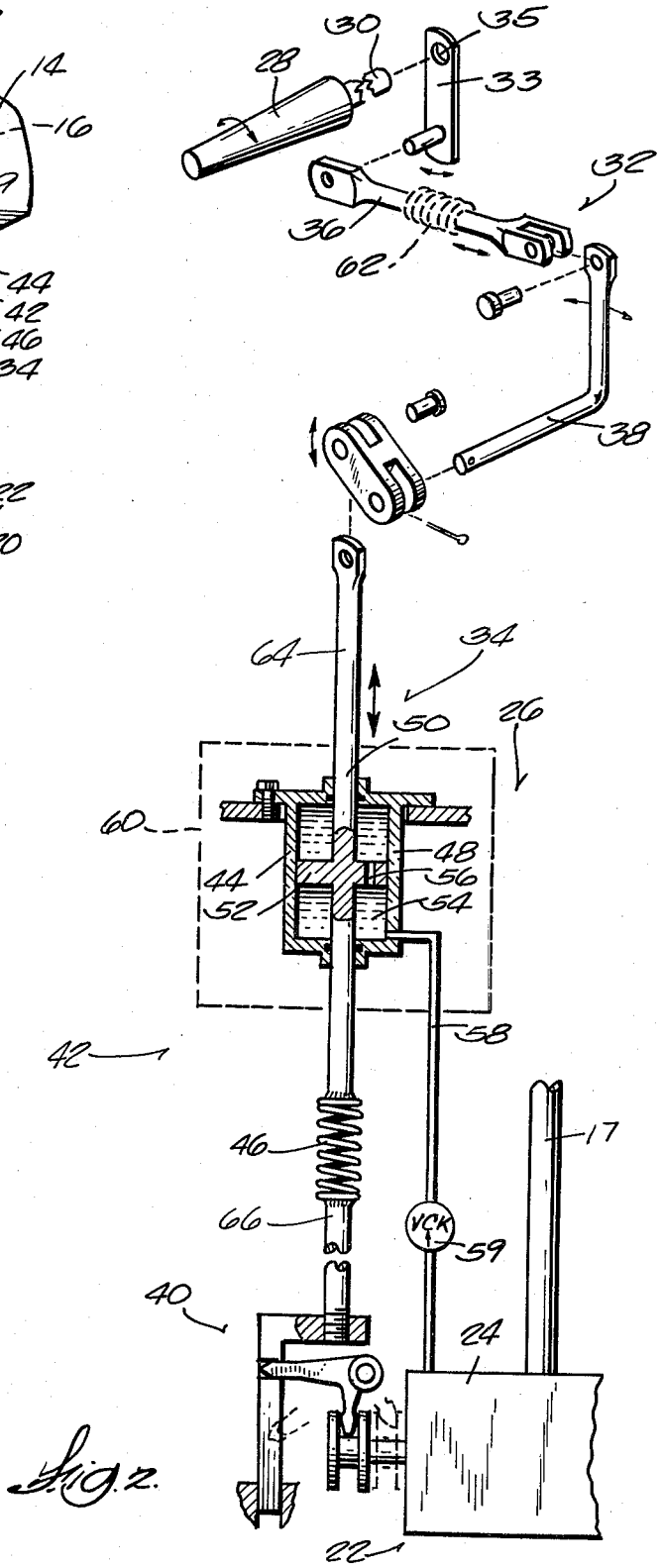
FIG. 2 is an exploded and partially broken away view of the shifting control mechanism incorporated in the marine propulsion device and taken generally along line 2—2 of FIG. 1.

A transmission mechanism 22 operatively connects the drive shaft 17 of the engine 16 with the propeller 20 (see FIG. 2). While various transmission mechanisms can be used, in the illustrated embodiment, a conventional transmission mechanism having a plurality of intermeshing gears (not shown) mounted inside a gear housing 24 is operable between a neutral position (shown in solid lines in FIG. 2) in which the engine 16 is operatively disconnected from the propeller 20 and a drive position (shown in phantom lines in FIG. 2) in which the engine 16 powers the propeller 20. Although only a single drive position is shown, it should be appreciated that two drive positions may be provided, one for powering the propeller 20 for forward drive and the other for powering the propeller 20 for reverse drive, and the invention is equally applicable for use.

Control means 26 is provided so that the operator can manually shift the transmission 22 between its neutral and drive positions. Generally, the control means 26 includes a suitable control handle unit which is operatively connected with the transmission mechanism 22 for transmitting operative forces from the control handle to the transmission mechanism 22 to operate the transmission mechanism 22 between its neutral and drive positions.

The control handle unit may be variously constructed and located with respect to the marine propulsion unit 12, and three possible embodiments are shown in FIG. 1. In the first embodiment (as shown in phantom lines in FIG. 1), a control box 25 is remotely located relative to the marine propulsion unit 12, such as on the hull of the boat (not shown), and a control lever 27 is movably mounted on the control box 25. In this embodiment, control cables 23 or the like couple the control lever 27 with the associated linkage means 32 located in the propulsion unit 12, which linkage means 32 will hereafter be described in greater detail. In the second alternative embodiment (also shown in phantom lines in FIG. 1), the control handle unit takes the form of a manually operable control member 29 (also shown in phantom lines in FIG. 1) which is mounted for movement directly on the propulsion unit 12. In the third alternative embodiment, which is shown in solid lines in FIG. 1, a steering handle 30 is attached to the propulsion unit 12, and a "twist" grip member 28 is mounted for rotation relative to the end of the steering handle 30.

In all three embodiments, the linkage means 32 is operatively connected with either the control lever 27, the control member 29, or the "twist" grip 28 for operating the transmission mechanism 22 in response to the movement of the respective members 27, 28, or 29. While the discussion will hereafter focus upon the specific operation of the "twist" grip embodiment (shown in solid lines in FIGS. 1 and 2), it should be appreciated that the other two embodiments of the control handle unit operate in similar fashion.

In the illustrated embodiment, the linkage means 32 includes a bellcrank 33 which is operatively connected with the control handle 28 (shown diagrammatically in FIG. 2) for rotation about a hub 35 in response to rotation or "twisting" of the control handle 28. Rotation thus imparted to the bellcrank 33 axially moves a link 36 which is in turn operatively connected with a shift lever 38 such that axial movement of the link 36 rotates the shift lever 38. A shift rod 34 is mounted for movement axially along its longitudinal axis and is operatively connected with the shift lever 38 such that rotation of the shift lever 38 imparts axial movement to the shift rod 34. The shift rod 34 is operatively connected by suitable coupling means 40 with the transmission mechanism 22 such that the axial movement of the shift rod will shift the transmission mechanism 22 between its neutral and drive positions.

Variations in engine torque and the engagement and disengagement of gears during shifting of the transmission mechanism 22 can create vibratory forces which emanate from the transmission mechanism 22. These vibratory forces, like the operative forces imparted by operation of the control handle 28, will axially move the shift rod 34 and thus be transmitted by the shift rod 34 from the transmission mechanism to the control handle 28. These vibratory forces, particularly those with higher frequency characteristics, create undesirable tactile sensations in the palm of the operator's hand and contribute to a general impression of "roughness" with respect to the operation of the transmission and associated shifting mechanisms.

Means 42 is provided for isolating or absorbing these undesirable vibratory forces from the control handle 28. More particularly, the isolation or absorbing means 42 includes a damper unit 44 and an associated spring 46 which are operatively coupled in series with each other on the shift rod 34. By virtue of this arrangement, the shift rod 34 is effectively divided into an upper portion 64 which is directly coupled with the control handle 28 through the heretofore described linkage means 32 and a lower portion 66 which is directly connected with the coupling means 40 of the transmission mechanism 22. The damper unit 44 is operatively connected with the upper portion 64 and is generally operative to resist axial movement of the upper portion 64, as will soon be described in greater detail. The spring 46 flexibly couples the upper portion 64, and in particular, the damper unit 44, with the lower portion 66.

Referring first to the damper unit, in the illustrated embodiment (FIG. 2), a hydraulic damper unit 44 is shown which includes a cylinder 48 enclosing a portion 50 of the upper portion 64 of the shift rod 34 and a piston 52 attached to the portion 50 of the shift rod 34 for movement within the cylinder 48 in common with axial movement of the upper portion 64 of the shift rod 34 itself. Hydraulic fluid 54 or a similar incompressible medium is confined within the cylinder 48, and the piston 52 includes one or more narrow ports 56 through which the hydraulic fluid 54 is forced when the piston 52 is moved through the cylinder 48.

The hydraulic damper unit 44 may be a sealed, self-contained unit. However, in the illustrated embodiment, a conduit 58 having a one way check valve 59 conducts transmission lubricating oil from the gear case 24 to the cylinder 48, there to be used as hydraulic fluid.

Axial movement of the upper portion 64 of the shift rod 34 is resisted by the damper unit 44 inasmuch as movement of the piston 52 forces the hydraulic fluid through the piston ports 56 and creates frictional forces. The magnitude of the frictional forces created depends in large part upon the velocity of the movement which is imparted to the upper portion 64. Generally, the higher the velocity of imparted movement is, the higher are the frictional forces created and the more substantial is the resultant resistance of the damper unit 44 to the transmission of such movement.

Since the vibratory forces which are transmitted from the transmission mechanism 22 to the damper unit 44 by the spring 46 impart relatively high velocity movement to the piston 52, the damper unit 44 generates relatively high resistive forces, and axial movement of the upper portion 64 of the shift rod 34 in response to such vibratory forces is substantially reduced. If the vibratory forces are of sufficiently high frequencies, axial movement of the upper portion 64 is effectively prevented.

The provision of the spring 46 permits the lower portion 66 of the shift rod 34 to move axially in response to the vibratory forces emanating from the transmission mechanism 22 independently of the upper portion 64, which is restrained from such axial movement by the damper unit 44. It should be apparent that the resultant "springing" of the lower portion 66 relative to the upper portion 64 effectively limits the magnitude of the vibratory force which is transmitted by the spring 46 to the damper unit 44 to a value less than it would be if the damper unit 44 were directly and inflexibly coupled with the transmission mechanism 22. As a result, the possibility that the resistance to axial movement generated by the damper unit 44 will be partially overcome by a vibratory force of sufficiently large magnitude is minimized. Thus, the damper unit 44 and the spring 46 operate together to isolate undesirable vibratory forces from the control handle 28.

On the other hand, since movement of the upper portion 64 in response to the twisting of the control handle 28 imparts relatively low velocity movement to the piston 52, relatively low frictional forces are developed by the damper unit 44, and relatively low resistance to such axial movement is encountered. Thus, the control handle 28 will operate the transmission mechanism 22, notwithstanding the presence of the damper unit 44 and the spring 46.

It should be appreciated that, instead of using a hydraulic damper unit 44 as heretofore described, a weighted member 60 (shown in phantom lines in FIG. 2) may be attached to the upper portion 64 of the shift rod 34 in place of the damper unit 44 and have a predetermined mass which would resist rapid, vibratory movement of the upper portion 64 much in the same way as the hydraulic damper unit 44.

In an alternative embodiment, a second helical spring 62 (shown in phantom lines in FIG. 2) in addition to the first mentioned spring 46 can be operatively connected with the link 36. Like the first described helical spring 46, the second helical spring 62 will be compressed in response to axial movement of the shift rod 34 transmitted by the shift lever 38. The use of two helical springs 46 and 62 in series with the hydraulic damper unit 44, one spring 62 above the damper unit 44 and the other spring 46 below the damper unit 44, allows the selection of mechanically "stiffer" springs. By virtue of the use of "stiffer" springs 46 and 62, lost motion of the shift rod 34 in response to operation of the control handle 28 is less in the two-spring embodiment than in the single spring embodiment, without affecting the desired isolation effect.

It should now be apparent that the damper unit 44 and the spring 46 or springs 46 and 62 act in combination to isolate the transmission of vibratory forces for the control handle 28, particularly those of higher frequency characteristics, while permitting operation of the transmission mechanism 22 by the control handle 28. As a result, a smoother "feel" is imparted to the overall operation of the transmission mechanism 22 without detracting from the overall control and responsiveness of the associated shifting mechanisms.

Various of the features of the invention are set forth in the following claims.

What is claimed is:

1. A marine propulsion device comprising a marine propulsion unit including an engine, a rotatably mounted propeller, transmission means operatively connected with said engine and said propeller for operation between a neutral position in which said engine is operatively disconnected from said propeller and a drive position in which said engine powers said propeller, said transmission means including a gearcase housing having confined therein an incompressible lubricating oil, and control means for operating said transmission means between said neutral position and said drive position, said control means including a movable control handle, a shift rod operatively connected between said control handle and said transmission means, having a longitudinal axis, and movable axially along said longitudinal axis in response to operative forces imparted by the movement of said control handle and in response to vibratory forces imparted by operation of said transmission means, and damper means for resisting the transmission of vibratory forces and comprising a cylinder enclosing a portion of said shift rod, a piston attached to said portion of said shift rod and movable within said cylinder in common with the movement of said shift rod axially along said longitudinal axis, and incompressible lubricating oil contained within said cylinder, and conduit means communicating between said gearcase housing and said cylinder for conducting lubricating oil therebetween.

2. A marine propulsion device according to claim 1 wherein said control means also includes spring means operatively connected between said control handle and said transmission means in series with said damper means and operative for limiting the magnitude of vibratory forces transmitted from said transmission means to said damper means.

3. A marine propulsion device according to claim 2 wherein said spring means includes a helical spring operatively connected intermediate said damper means and said transmission means for compression in response to movement of said shift rod axially along said longitudinal axis.

4. A marine propulsion device according to Claim 2 wherein said spring means includes a helical spring operatively connected intermediate said damper means and said control handle for compression in response to the movement of said shift rod axially along said longitudinal axis.

5. A marine propulsion device according to claim 2 wherein said spring means includes a first helical spring operatively connected intermediate said hydraulic damper means and said transmission means and a second helical spring operatively connected intermediate said hydraulic damper means and said control handle.

6. A marine propulsion device according to claim 1 and further including a steering handle attached to said marine propulsion unit, and wherein said control handle is mounted on said steering handle for rotation relative thereto.

7. A marine propulsion device according to claim 1 and further including a control box remotely spaced from said marine propulsion unit, and wherein said control handle is mounted on said control box for movement relative thereto.

* * * * *